US005145177A

United States Patent [19]

Wells

[11] Patent Number: 5,145,177

[45] Date of Patent: Sep. 8, 1992

[54] STACKING PIECE PUZZLE

[76] Inventor: Loren B. Wells, 4795 Redrock Dr., Larkspur, Colo. 80110

[21] Appl. No.: 792,783

[22] Filed: Nov. 15, 1991

[51] Int. Cl.[5] ..... A63F 9/12

[52] U.S. Cl. ..... 273/157 R; 273/156; 446/117

[58] Field of Search ..... 273/153 R, 155, 156, 273/157 R, 282 B; 434/259; 446/69, 117, 118, 122

[56] References Cited

U.S. PATENT DOCUMENTS

| | | | |
|---|---|---|---|
| D. 237,642 | 11/1975 | Baynes | 273/156 |
| 423,066 | 3/1890 | Massey | 446/117 |
| 771,072 | 9/1904 | Jackson | 273/156 |
| 2,775,234 | 11/1955 | Coble et al. | 273/157 R |
| 2,905,474 | 9/1959 | Jahr | 273/153 R |
| 3,523,384 | 8/1970 | Adelsohn | 273/157 R |
| 3,630,527 | 12/1971 | Breslow | 273/157 R |
| 3,829,100 | 8/1974 | Nielsen | 273/157 R |
| 4,040,630 | 8/1977 | Brattain | 273/157 R |
| 4,357,016 | 11/1982 | Allison | 273/156 |
| 4,397,466 | 8/1983 | Nichols | 273/156 |
| 4,437,668 | 3/1984 | Simpson et al. | 273/156 |
| 4,509,753 | 4/1985 | Vaughan, Jr. | 273/110 |
| 4,509,920 | 4/1985 | Kaufmann | 273/157 R |
| 4,974,848 | 12/1990 | Gieseker | 273/153 R |

*Primary Examiner*—Paul E. Shapiro
*Assistant Examiner*—Steven B. Wong
*Attorney, Agent, or Firm*—Reinhart, Boerner, Van Deuren, Norris & Rieselbach

[57] ABSTRACT

A stacking puzzle including a plurality of stackable, game pieces and one or more solid game rods. Each of the game pieces includes an aperture extending obliquely therethrough. When the game pieces are properly stacked and oriented relative to one another, the oblique apertures line up and allow the game rods to be inserted through all the game pieces. However, the game pieces must be stacked in the proper order and must be placed in the proper orientation relative to one another in order for the apertures to align properly. Although there are a multitude of incorrect ways to arrange the game pieces, only one correct arrangement causes the apertures to align and thereby permit the game rod to be inserted through the game pieces. In one embodiment, the faces of the game pieces are made nonparallel to provide an additional degree of freedom and thereby further increase the challenge of the puzzle.

16 Claims, 3 Drawing Sheets

STACKING PIECE PUZZLE

BACKGROUND OF THE INVENTION

This invention relates generally to puzzles and, more particularly, to three dimensional stacking piece puzzles.

An important attribute of any successful puzzle is its ability to understate its true level of difficulty. In other words, those puzzles that are most successful are the ones that, at first glance, appear so simple as to be almost trivial, but which, upon closer acquaintance, prove to be maddeningly difficult to solve.

In designing a puzzle, it is appropriate to take into consideration the age and ability level of the intended players. A child's puzzle, such as that shown for example in U.S. Pat. No. 2,905,474 which issued to Jahr on Sep. 22, 1959, is intentionally made easy to understand and simple to operate. Puzzles intended for adults are intentionally made more difficult to solve, and in some puzzles, such as that shown in U.S. Pat. No. 4,974,848 which issued to Gieseker on Dec. 4, 1990, it is possible to construct the puzzle in varying degrees of complexity according to the skill level or sophistication of the user.

In view of the foregoing, well designed adult puzzles are those that appear almost childlike in their simplicity but which in reality provide a level of difficulty and sophistication sufficient to challenge and satisfy adults.

SUMMARY OF THE INVENTION

The invention provides a puzzle including a plurality of game pieces that are stackable atop each other. Each of the game pieces includes an aperture extending obliquely therethrough. The apertures are located in the game pieces so as to be aligned with one another only when the game pieces are stacked in a unique order and positioned to a unique orientation relative to one another. The puzzle further includes an elongate, rigid game dowel that is dimensioned to be received in the aligned apertures of the game pieces only when the game pieces are stacked in the unique order and placed in the unique orientation. The object of the puzzle is to arrange the game pieces so as to align the apertures and thereby allow the passage of the game dowel therethrough.

The invention also provides a puzzle comprising a base and a center post projecting upwardly from the base. The puzzle further includes a plurality of game pieces, each including a center aperture dimensioned to receive the center post therethrough. Each of the game pieces further includes a pair of opposed, nonparallel, substantially planar upper and lower surfaces. The nonparallel upper and lower surfaces are oriented so that the game pieces can be stacked atop one another over the base and around the center post to form a substantially solid structure only when the game pieces are stacked in a unique order and are positioned to a unique orientation relative to one another.

In one embodiment, the game pieces are substantially circular in form.

In one embodiment, the game pieces are substantially triangular in form.

In one embodiment, the puzzle also includes a base having an upwardly extending, substantially vertical center dowel over and around which the game pieces are placed.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENTS

Figure 1:
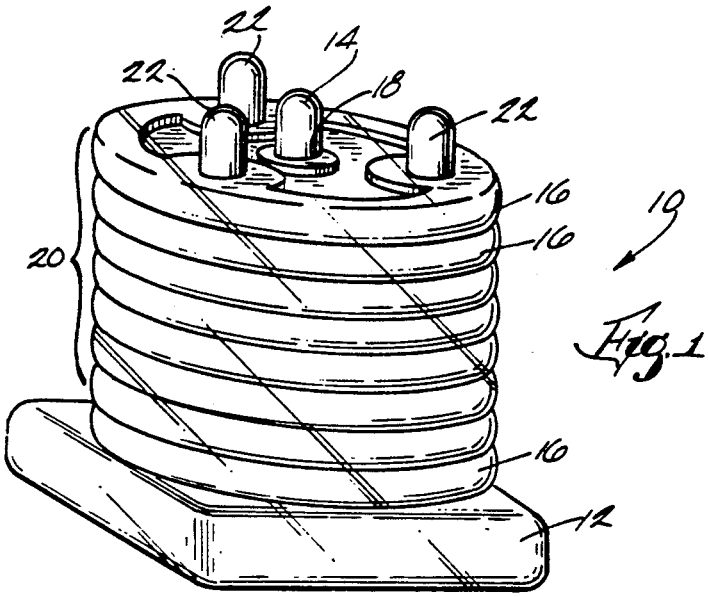
FIG. 1 is a perspective view of a stacking puzzle constructed in accordance with various aspects of the invention.
Figure 2:
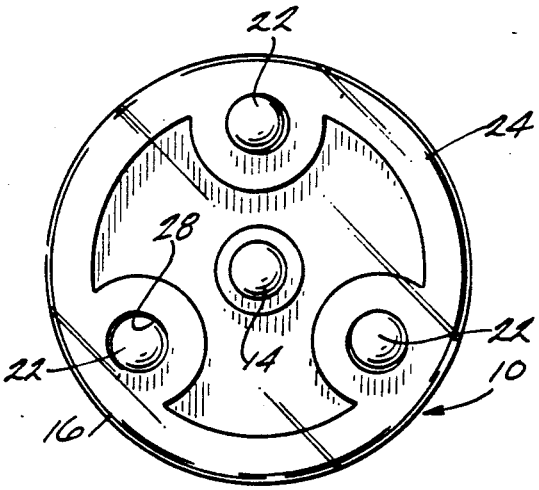
FIG. 2 is a top plan view of the puzzle shown in FIG. 1.
Figure 3:
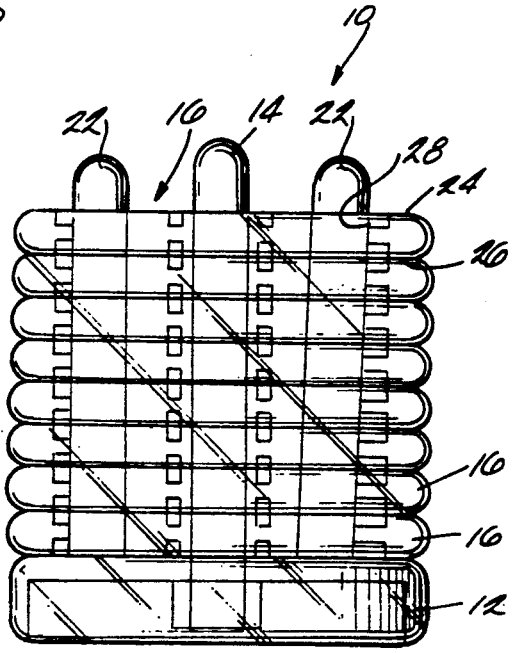
FIG. 3 is a side elevation view of the puzzle shown in FIG. 1.

Referring to the drawings, and, in particular to FIGS. 1-3, a stacking piece puzzle 10 constructed in accordance with various aspects of the invention is illustrated. In the illustrated embodiment, the puzzle 10 includes a square base portion 12 having a substantially vertical, upwardly extending center post 14. The puzzle further includes a plurality of stackable game pieces 16 which, in the illustrated embodiment, have the general form of circular disks.

As illustrated, each game piece 16 includes a center aperture 18. Collectively, the center apertures 18 enable the game pieces 16 to be stacked atop one another over the base 12 and around the center post 14. When the game pieces 16 are so stacked, they form a substantially solid structure 20 surrounding the center post 14. The puzzle 10 further includes a plurality of elongate, substantially rigid rods or game dowels 22 that can, but need not, be similar in size and shape to the center post 14. In further accordance with one aspect of the invention, each of the game pieces 16 includes an upper surface 24 and a lower surface 26 and further includes an aperture 28 extending obliquely through the upper and lower surfaces 24, 26. The apertures 28 in the game pieces 16 are so located and oriented that, when the game pieces 16 are stacked as shown in FIGS. 1 and 3, the apertures 28 in the game pieces 16 align to form a passage in which a game dowel 22 can be received. In the illustrated embodiment, three game dowels 22 are provided and each game piece 16 includes three apertures 28 in addition to the center aperture 18 through which the center post 14 is received. Preferrably, the apertures 28 are located and oriented so that each of the game dowels 22 assumes a unique, skewed or nonvertical orientation when the game pieces 16 are properly stacked and aligned and the game dowels 22 inserted through the aligned apertures 28.

When the puzzle 10 is to be used, the individual game dowels 22 are removed and the game pieces 16 are lifted off of the center post 14. The game pieces 16 are then "mixed up" or otherwise placed in random order. The object of the puzzle 10 is to reassemble the game pieces 16 onto the base 12 and center post 14 so as to align the apertures 28 and permit the reintroduction of all three game dowels 22. Because the apertures 28 are positioned and located so that the game dowels 22 lie at unique, skewed angles relative to the base 12, it is necessary, in order to achieve success, that the game pieces 16 be placed onto the base 12 in the correct order with the correct side "up". It is also necessary that the rotational positions of the game 16 pieces relative to one another around the center post 14 be correct. Depending on the number of game pieces 16 involved, there can be a tremendous number of "incorrect" ways to assembly the game pieces 16 with only one "correct" way available. The true difficulty and challenge of the puzzle 10 is sometimes not appreciated until after the game pieces 16 are scattered and reassembly is attempted.

Although the materials used in the construction of the puzzle 10 are not critical, in the preferred embodiment the game pieces 16, as well as the base 12, the center post 14 and the game dowels 22, are all molded from a rigid, transparent, thermoplastic material such as clear acetate, butyrate plastic. Although the specific number of game pieces 16 and game dowels 22 can be varied in order to change the relative difficulty of the puzzle 10, in the preferred embodiment, eight game pieces 16 and three game dowels 22 are provided.

Figure 4:
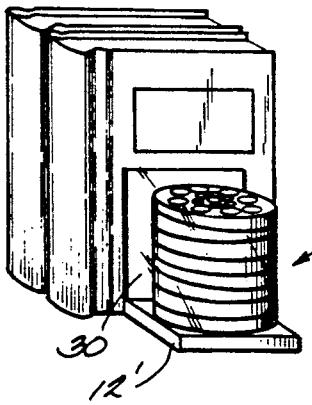
FIG. 4 is a perspective view of an alternate embodiment of the puzzle constructed in accordance with various aspects of the invention.
Figure 5:
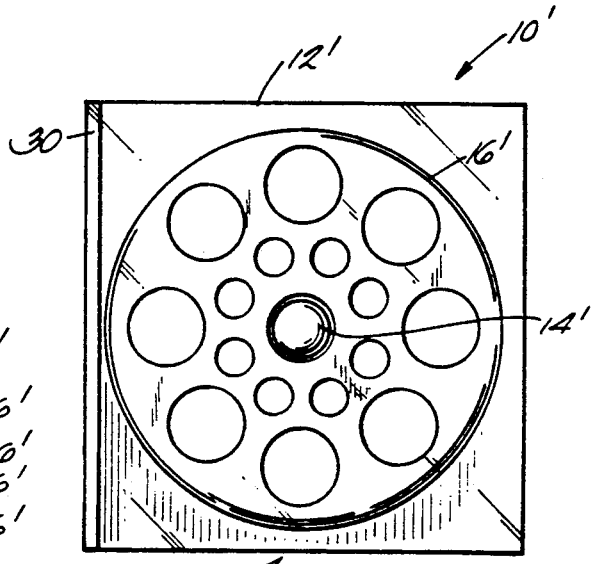
FIG. 5 is a top plan view of the puzzle shown in FIG. 4.
Figure 6:
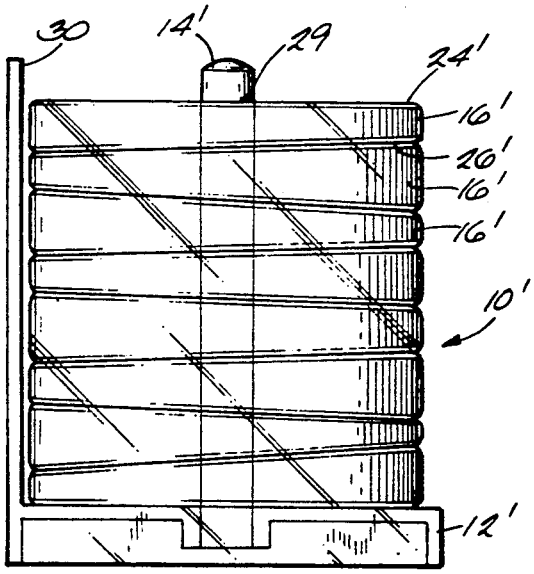
FIG. 6 is a side elevation view of the puzzle shown in FIG. 4.

An alternate embodiment of the puzzle 10' is illustrated in FIGS. 4, 5 and 6. In this embodiment, the game pieces 16' include upper and lower surfaces 24', 26' that are nonparallel. Furthermore, the relative angles between the upper and lower surfaces 24', 26' in each of the game pieces 16' varies from piece to piece. In this embodiment, the object of the puzzle 10' is to reassemble each of the game pieces 16' onto the base 12' around the center post 14' so as to reform the substantially solid structure 20' that results when the game pieces 16' are stacked in the proper order and placed in the proper orientation relative to one another.

It will be appreciated that the height of the solid structure 20' will be at a minimum only when the game pieces 16' are properly stacked and oriented. In other words, if the game pieces 16' are not in the proper order and orientation, the height of the solid structure 20' will be greater than the minimum possible height. Accordingly, a notch, mark or other indication 29 is made on the center post 14' at the minimum stack height level. During play, the game pieces 16' are arranged so as to place the top of the solid structure at the level of the mark 29.

Figure 7:
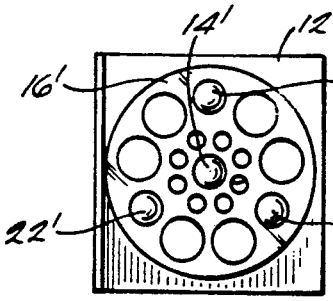
FIG. 7 is a top plan view of an alternate arrangement of the embodiment shown in FIG. 4.
Figure 8:
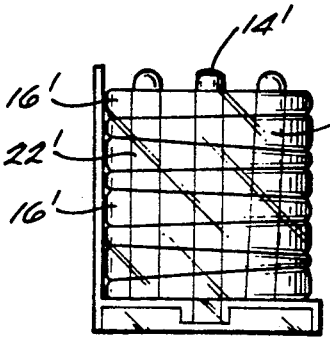
FIG. 8 is a side elevation view of the puzzle shown in FIG. 7.

As illustrated in FIGS. 7 and 8, the game pieces 16' can include apertures 28' similar or identical to those shown and described in connection with FIGS. 1–3. In addition, one or mare game dowels 22' can be included. In this embodiment, the game pieces 16' continue to have non-parallel faces, and the object of the puzzle is to stack and orient the game pieces so as to permit passage of the game dowels 22' through the aligned apertures 28'.

Figure 9:
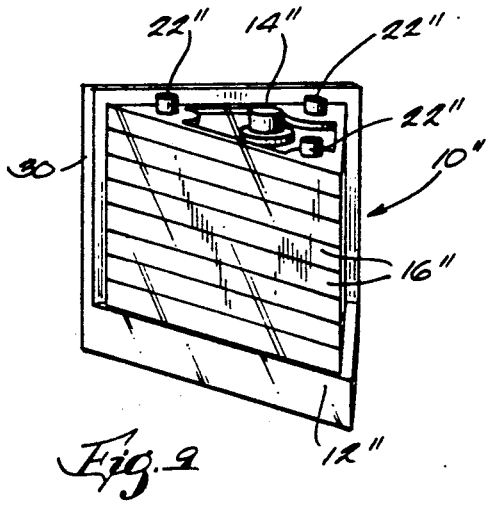
FIG. 9 is a perspective view of still another alternate embodiment of the puzzle constructed in accordance with various aspects of the invention.
Figure 10:
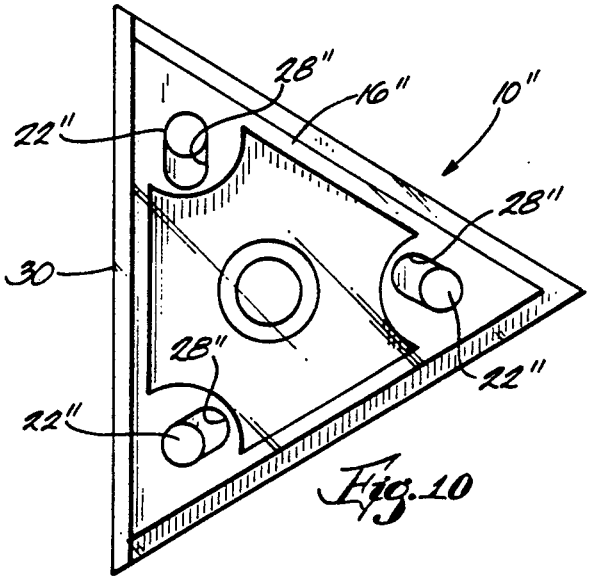
FIG. 10 is a top plan view of the puzzle shown in FIG. 9.
Figure 11:
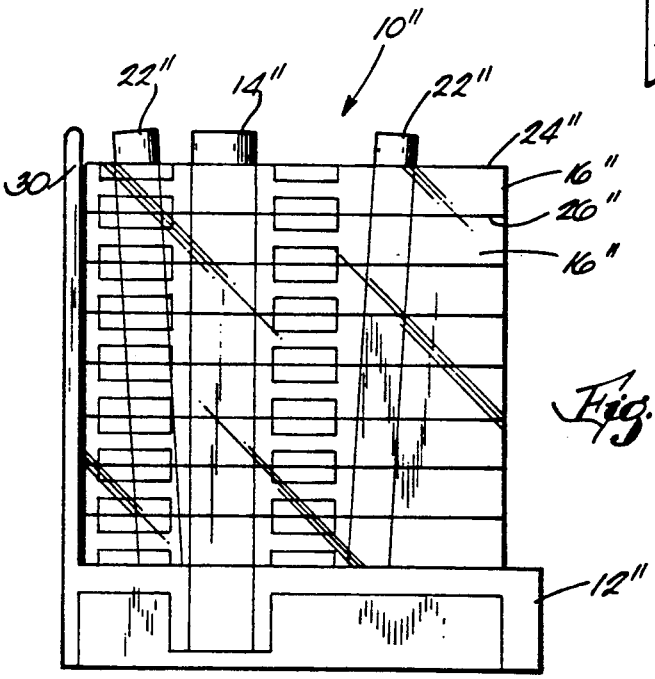
FIG. 11 is a side elevation view of the puzzle shown in FIG. 9.

Still another embodiment of the puzzle 10'' is shown in FIGS. 9, 10 and 11. In this embodiment, which is otherwise similar to the embodiment shown in FIGS. 1, 2, and 3, the game pieces 16'' are of triangular form rather than the circular disk-like form shown in FIGS. 1–3.

As illustrated in FIGS. 1–3, the base 12 can comprise a simple square having the center post 14 extending upwardly from its center. Alternatively, and as illustrated in FIGS. 4–9, the base 12' can include an integral, vertical panel 30 at one side. This enables the assembled puzzle to be used as, for example, a bookend as best seen in FIG. 4. This feature can be incorporated into any of the embodiments shown in FIGS. 1–11.

As previously noted, the materials used in the construction of the puzzle are not critical provided they are reasonably durable and rigid enough to resist substantial deformation during use. Although circular and triangular game pieces 16, 16'' have been shown and described, these shapes are not critical and the puzzle 10 can be implemented using game pieces 16 having other (e.g. pentagonal or hexagonal) shapes. Additionally, the precise number of game pieces 16 and the precise number and cross sectional shapes of the game dowels 22 can differ from those shown in the figures. Finally, the puzzle need not be implemented in the form of actual, physically real objects but may, for example, be represented as a computer generated display on an appropriate display screen.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A puzzle comprising:

a plurality of game pieces stackable atop each other, each of said game pieces including an aperture extending obliquely therethrough, said apertures being located in said game pieces so as to be aligned with one another only when said game pieces are stacked in a unique order and positioned to a unique orientation relative to one another; and an elongated rigid member dimensioned to be received in said aligned apertures of said game pieces only when said game pieces are stacked in said unique order and positioned to said unique orientation;

the object of said puzzle being to arrange said game pieces so as to align said apertures to allow the passage of said elongate rigid member obliquely therethrough.

2. A puzzle as defined in claim 1 wherein said puzzle further includes a base member having an upwardly extending, substantially vertical center post and wherein each of said game pieces includes an additional center aperture permitting said game pieces to be stacked atop said base around said center post.

3. A puzzle as defined in claim 2 wherein said elongate rigid member comprises a straight game dowel of substantially circular cross section.

4. A puzzle as defined in claim 3 wherein said puzzle includes a plurality of said game dowels and wherein each of said game pieces includes a plurality of said apertures extending obliquely therethrough to receive therein said plurality of game dowels.

5. A puzzle as defined in claim 4 wherein each of said game pieces is of substantially circular disk-like form.

6. A puzzle as defined in claim 5 wherein each of said game pieces is of substantially triangular form.

7. A puzzle comprising:

a base member having an upstanding substantially vertical center post;

a plurality of game pieces, each of said game pieces having a center aperture dimensioned to receive said center post therethrough so that said game pieces are stackable atop one another over said base member and around said center post;

each of said game pieces having an aperture formed obliquely therethrough, said apertures being located in said game pieces so as to be aligned with one another only when said game pieces are stacked in a unique order and wherein each of said game pieces is positioned to a unique rotational position around said center post relative to the remaining ones of said game pieces; and an elongate, substantially straight rigid game rod insertable into said aligned apertures of said game pieces;

the object of said puzzle being to stack said game pieces in said unique order on said base and to position said game pieces in said unique rotational positions around said center post so as to align said apertures and allow thereby the passage of said game rod therethrough.

8. A puzzle as defined in claim 7 wherein each of said game pieces includes a plurality of said apertures formed obliquely therethrough and wherein said puzzle includes a plurality of said game rods.

9. A puzzle as defined in claim 8 wherein each of said game rods is oriented at a unique oblique angle relative to said base when said puzzle is assembled and said game rods are received through said aligned apertures.

10. A puzzle as defined in claim 9 wherein each of said game pieces includes substantially parallel upper and lower surfaces.

11. A puzzle comprising:

a base;

a substantially vertical center dowel projecting upwardly from said base;

a plurality of game pieces, each having a center aperture dimensioned to receive said center dowel therethrough, stacked atop one another and around said center dowel to form a substantially solid stack atop said base around said center dowel;

a plurality of elongate rigid game dowels; and a plurality of apertures formed obliquely through said stacked game pieces dimensioned to receive therein said game dowels;

said apertures being located and arranged so that each of said game dowels is oriented at a unique oblique angle relative to a horizontal plane when it received in a respective one of said apertures and so that each of said game dowels is located at a unique distance from said center dowel when it is received in a respective one of said apertures.

12. A puzzle as defined in claim 11 wherein each of said game pieces includes substantially parallel upper and lower surfaces.

13. A puzzle as defined in claim 12 wherein said base includes a substantially vertical upwardly extending panel.

14. A puzzle as defined in claim 13 wherein said puzzle includes eight of said game pieces and three of said elongate rigid game dowels.

15. A puzzle comprising:

a base;

a center post projecting upwardly from said base; and a plurality of game pieces, each of said game pieces including a center aperture dimensioned to receive said center post therethrough and each of said game pieces further including a pair of opposed, nonparallel, substantially planar upper and lower surfaces;

said nonparallel upper and lower surfaces being oriented so that said game pieces can be stacked atop one another over said base and around said center post to form a substantially solid structure only when said game pieces are stacked in a unique order and are positioned to a unique orientation relative to one another.

16. A puzzle as defined in claim 15 wherein said center post includes an indication representing the minimum possible height of said substantially solid structure, said minimum possible height being attainable only when said game pieces are stacked in said unique order and positioned to said unique orientation relative to one another.

* * * * *